US007834717B2

(12) United States Patent
Wada et al.

(10) Patent No.: US 7,834,717 B2
(45) Date of Patent: Nov. 16, 2010

(54) NONRECIPROCAL CIRCUIT DEVICE

(75) Inventors: Takaya Wada, Otsu (JP); Hiroaki Kikuta, Moriyama (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 12/700,810

(22) Filed: Feb. 5, 2010

(65) Prior Publication Data

US 2010/0127793 A1 May 27, 2010

Related U.S. Application Data

(63) Continuation of application No. PCT/JP2008/064051, filed on Aug. 5, 2008.

(30) Foreign Application Priority Data

Aug. 22, 2007 (JP) ..... 2007-215827

(51) Int. Cl.
*H01P 1/36* (2006.01)

(52) U.S. Cl. ..... 333/24.2; 333/1.1

(58) Field of Classification Search ..... 333/1.1, 333/24.2

See application file for complete search history.

(56) References Cited

U.S. PATENT DOCUMENTS 6,940,360 B2 9/2005 Takeda et al.
2007/0236304 A1 10/2007 Kawanami

FOREIGN PATENT DOCUMENTS

| | | | |
|---|---|---|---|
| EP | 0 843 375 | A1 | 5/1998 |
| JP | 10-145111 | A | 5/1998 |
| JP | 2002-314308 | A | 10/2002 |
| JP | 2007-208320 | A | 8/2007 |
| WO | 2007/046229 | A1 | 4/2007 |

OTHER PUBLICATIONS

Official Communication issued in International Patent Application No. PCT/JP2008/064051, mailed on Nov. 18, 2008.

Wada et al.; "Nonreciprocal Circuit Device"; U.S. Appl. No. 12/700,806, filed Feb. 5, 2010.

Kitamori et al.; "Non-Reciprocal Circuit Device"; U.S. Appl. No. 12/700,814, filed Feb. 5, 2010.

*Primary Examiner*—Stephen E Jones
(74) *Attorney, Agent, or Firm*—Keating & Bennett, LLP

(57) ABSTRACT

A nonreciprocal circuit device (2-port isolator) includes a ferrite-magnet assembly including a ferrite, a first center electrode, and a second center electrode. The ferrite is sandwiched between a pair of permanent magnets and receives a direct-current magnetic field applied thereto. The first and second center electrodes are arranged on the ferrite. The ferrite includes a center layer and an outer layer ensuring an insulation state of the first and second center electrodes. The saturation magnetization of the outer layer is smaller than that of the center layer.

7 Claims, 4 Drawing Sheets

NONRECIPROCAL CIRCUIT DEVICE

BACKGROUND OF THE INVENTION

1. Field of the Invention

The present invention relates to nonreciprocal circuit devices and, in particular, to a nonreciprocal circuit device, such as an isolator or a circulator, used in microwave bands.

2. Description of the Related Art

Nonreciprocal circuit devices, such as isolators or circulators, have a characteristic that allows a signal to be transmitted only in a predetermined specific direction and not in the opposite direction. This characteristic is used by, for example, an isolator used in a transmitting circuit of a mobile communication device, such as an automobile phone or a cellular phone.

This type of a nonreciprocal circuit device includes a ferrite having a center electrode, a permanent magnet for applying a direct-current magnetic field thereto, and other components, such as a matching capacitance and a resistor. International Publication No. WO2007-046229 describes a nonreciprocal circuit device in which a first center electrode and a second center electrode are wound around two principal front and back surfaces of a ferrite, the first and second center electrodes being insulated from and intersecting each other and made of a conductive film, to obtain a smaller insertion loss.

However, in the nonreciprocal circuit device described in International Publication No. WO2007-046229, an insulating layer is disposed between the first and second center electrodes made of the conductive film on the principal surfaces of the ferrite (magnetic substance with a firing temperature of 1,350° C.), and the insulating layer is made of non-magnetic material, such as glass, (firing temperature is 1,000° C.). It is difficult to simultaneously fire these elements, so the number of steps in a production process and the cost are increased. For simplifying the production process and reducing the cost, co-firing is useful. However, the structure in which the ferrite is sandwiched between the pair of permanent magnets presents the problem of increasing an insertion loss if the ferrite and the insulating layer are made of exactly the same material.

From the viewpoint of integrally firing a ferrite, Japanese Unexamined Patent Application Publication No. 10-145111 and Japanese Unexamined Patent Application Publication No. 2002-314308 describe laminating and firing ferrites having different saturation magnetization values. However, in the nonreciprocal circuit device described in Japanese Unexamined Patent Application Publication No. 10-145111, the ferrites having a center electrode have the same saturation magnetization value, so the problem of increasing an insertion loss cannot be solved. Japanese Unexamined Patent Application Publication No. 2002-314308 describes increasing saturation magnetization of a ferrite layer adjacent to a permanent magnet and making the magnetic field distribution uniform.

SUMMARY OF THE INVENTION

Accordingly, preferred embodiments of the present invention provide a nonreciprocal circuit device capable of decreasing the number of the manufacturing processes to reduce the manufacturing cost and capable of preventing an increase in the insertion loss.

A nonreciprocal circuit device according to one preferred embodiment of the present invention includes permanent magnets, a ferrite to which a direct-current magnetic field is applied by the permanent magnets, and a first center electrode and a second center electrode arranged so as to intersect each other on the ferrite in an insulation state in which the first and second center electrodes are electrically insulated from each other, each of the first and second center electrodes being made of a conductive film. The ferrite and the permanent magnets define a ferrite-magnet assembly in which the ferrite is sandwiched between the permanent magnets in parallel or substantially in parallel with surfaces of the ferrite on which the first and second center electrodes are disposed. The ferrite includes a center layer and an outer layer. The outer layer ensures the insulation state of the first center electrode and the second center electrode. Saturation magnetization of the outer layer is smaller than saturation magnetization of the center layer.

In the above-described nonreciprocal circuit device, the ferrite includes the center layer and the outer layer (insulating layer) ensuring the insulation state of the first center electrode and the second center electrode. Accordingly, the center layer and the insulating layer can be fired integrally at the same time. In addition, even with the same ferrite (microwave magnetic material), because the saturation magnetization of the outer layer is smaller than that of the center layer, the center layer differs from the outer layers in permeability. Thus, an isolation characteristic similar to a configuration that uses non-magnetic material in the outer layer is obtainable, and an increase in insertion loss can be prevented.

With a preferred embodiment of the present invention, it is possible to provide a nonreciprocal circuit device that is capable of decreasing the number of the manufacturing processes to reduce the manufacturing cost and that has a smaller insertion loss because the ferrite can be integrally and simultaneously fired.

Other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Preferred embodiments of a nonreciprocal circuit device according to the present invention will herein be described with reference to the attached drawings.

Figure 1:
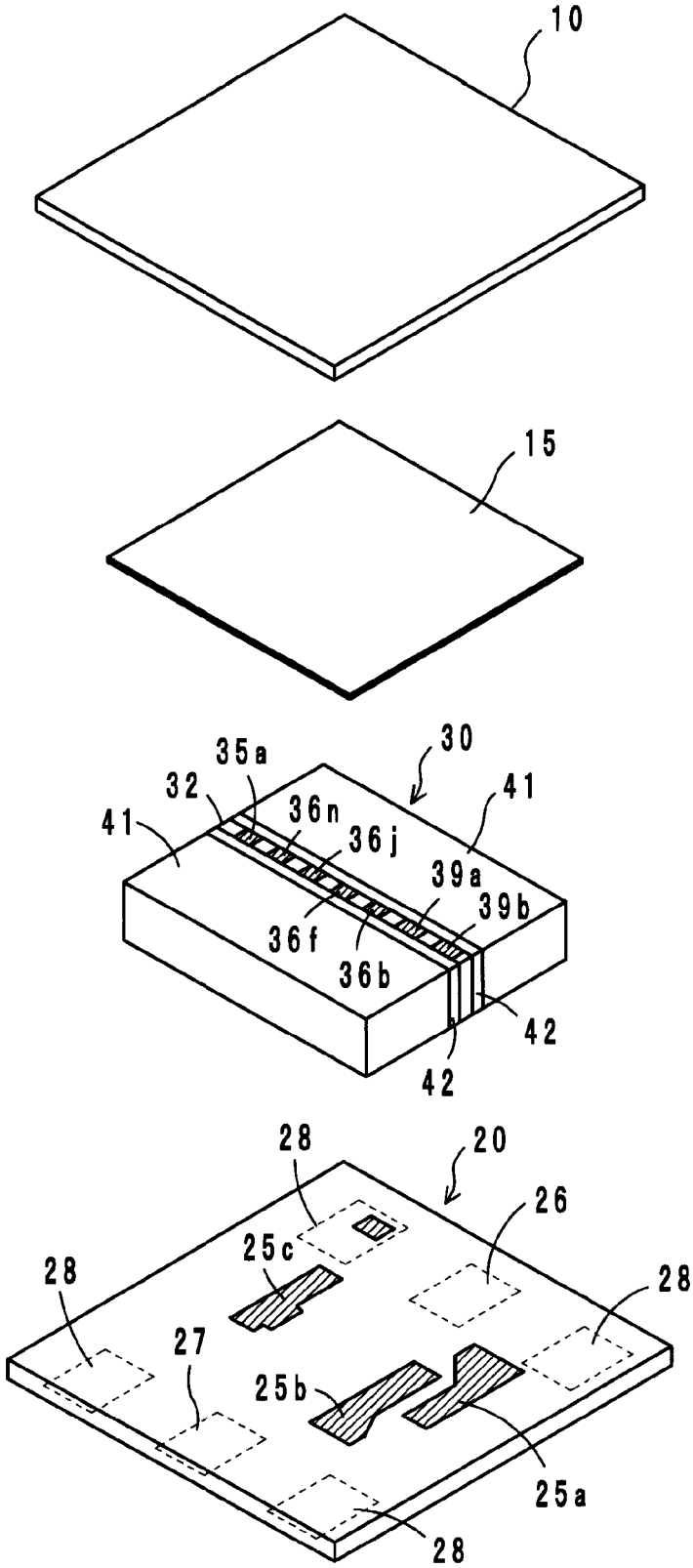
FIG. 1 is an exploded perspective view showing a preferred embodiment of a nonreciprocal circuit device (two-port isolator) according to the present invention.

FIG. 1 is an exploded perspective view of a 2-port isolator according to a preferred embodiment of a nonreciprocal circuit device of the present invention. The 2-port isolator is a lumped-constant isolator and generally includes a flat-shaped yoke 10, a circuit board 20, and a ferrite-magnet assembly 30 including a ferrite 32 and permanent magnets 41. In FIG. 1, the diagonally shaded portions indicate a conductor.

Figure 2:
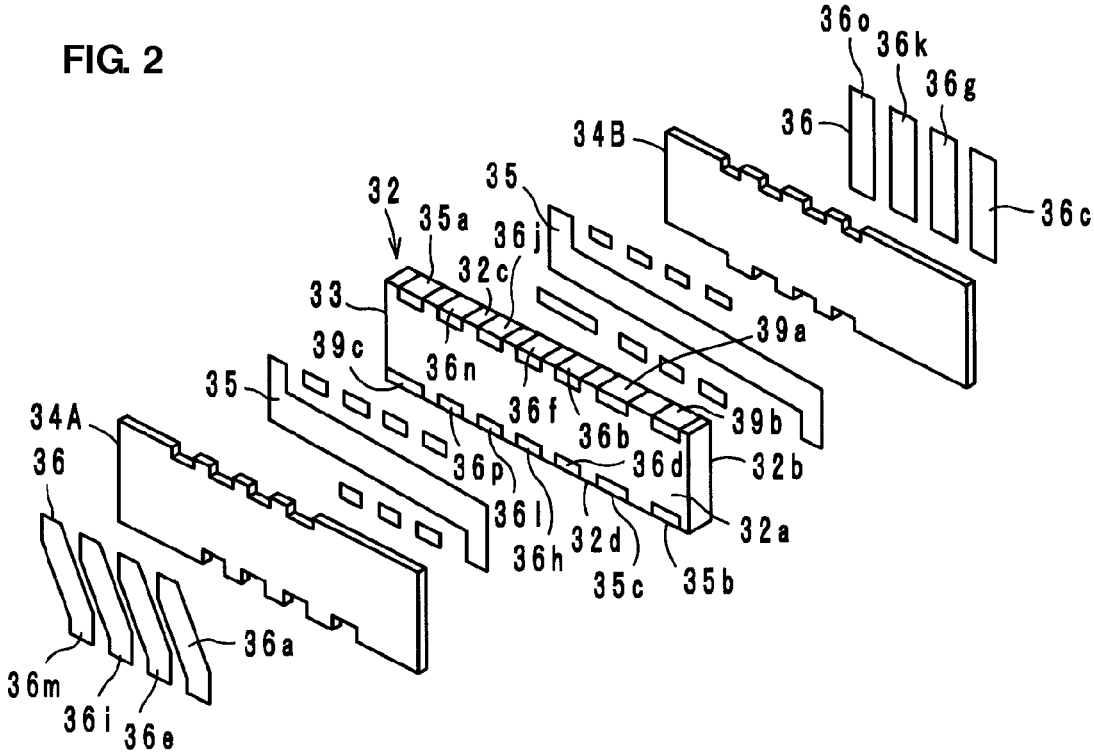
FIG. 2 is an exploded perspective view showing a ferrite with center electrodes.

As shown in FIG. 2, the ferrite 32 includes a center layer 33 and two outer layers 34A and 34B. In each of these layers, a microwave magnetic material is preferably used. In the outer layers 34A and 34B, a material having a saturation magnetization smaller than that of the center layer 33 is used. The outer layers 34A and 34B function as an insulating layer ensuring an insulation state of first and second center electrodes 35 and 36. The material of each of the center layer 33 and the outer layers 34A and 34B will be described in detail below.

The center layer 33 of the ferrite 32 preferably has a substantially rectangular parallelepiped shape, for example. A first principal surface is represented by reference numeral 32*a*, a second principal surface is represented by reference numeral 32*b*, and upper and lower surfaces are represented by reference numerals 32*c* and 32*d*, respectively.

The permanent magnets 41 are fixed to the ferrite 32 with, for example, an epoxy-based adhesive 42 (see FIG. 1) disposed therebetween so as to face the principal surfaces 32*a* and 32*b* such that magnetic fields of the permanent magnets 41 are applied to the ferrite 32 in a perpendicular or substantially perpendicular direction to the principal surfaces 32*a* and 32*b*. The permanent magnet 41 and the ferrite 32 define the ferrite-magnet assembly 30. The principal surfaces of the permanent magnets 41 have substantially the same dimensions as those of the principal surfaces 32*a* and 32*b* and are opposed to them such that their outer shapes match each other.

The first center electrode 35 is preferably made of a conductive film and disposed on the first and second principal surfaces 32*a* and 32*b* of the center layer 33. That is, the first center electrode 35 disposed on the first principal surface 32*a* extends upward from a lower right portion toward an upper left portion and tilts toward the long side at a relatively small angle. The first center electrode 35 extending upward toward the upper left portion extends toward the second principal surface 32*b* such that a relay electrode 35*a* on the upper surface 32*c* is disposed between the principal surfaces 32*a* and 32*b*. The first center electrode 35 disposed on the second principal surface 32*b* substantially overlaps that on the first principal surface 32*a* in perspective view. A first end of the first center electrode 35 is connected to a connection electrode 35*b* disposed on the lower surface 32*d*. A second end of the first center electrode 35 is connected to a connection electrode 35*c* disposed on the lower surface 32*d*. In such a way, the first center electrode 35 is wound around the ferrite 32 by one turn. The outer layers (insulating layers) 34A and 34B are disposed on the principal surfaces 32*a* and 32*b*, respectively, on which the first center electrode 35 is disposed, and ensures insulation from the second center electrode 36, which is described below.

The second center electrode 36 is preferably made of a conductive film on the outer layers 34A and 34B. First, a 0.5th-turn section 36*a* extends from a lower right portion toward an upper left portion on the outer layer 34A, tilts toward the long side at a relatively large angle, and intersects the first center electrode 35. The 0.5th-turn section 36*a* extends toward the outer layer 34B, on which a 1st-turn section 36*c* extends, such that a relay electrode 36*b* on the upper surface 32*c* is disposed therebetween. The 1st-turn section 36*c* intersects the first center electrode 35 at a substantially right angle on the outer layer 34B. The lower end of the 1st-turn section 36*c* extends toward the outer layer 34A, on which a 1.5th-turn section 36*e* extends, such that a relay electrode 36*d* on the lower surface 32*d* is disposed therebetween. The 1.5th-turn section 36*e* is parallel or substantially parallel with the 0.5th-turn section 36*a* on the outer layer 34A and intersects the first center electrode 35. The 1.5th-turn section 36*e* extends toward the outer layer 34B such that a relay electrode 36*f* is disposed on the upper surface 32*c* between the 1.5th-turn section 36*e* and a 2nd-turn section 36*g*. In a similar manner, the 2nd-turn section 36*g*, a relay electrode 36*h*, a 2.5th-turn section 36*i*, a relay electrode 36*j*, a 3rd-turn section 36*k*, a relay electrode 36*l*, a 3.5th-turn section 36*m*, a relay electrode 36*n*, and a 4th-turn section 36*o* are disposed on the surfaces of the ferrite 32. The opposite ends of the second center electrode 36 are connected to the connection electrodes 35*c* and 36*p*, respectively, being disposed on the lower surface 32*d*. The connection electrode 35*c* is shared by the first and second center electrodes 35 and 36 as the connection electrodes for their ends.

That is, the second center electrode 36 is helically wound around the ferrite 32 by four turns, for example. Here, for the number of turns, a state in which the second center electrode 36 traverses the principal surface 32*a* or 32*b* once is counted as 0.5 turn. The crossing angle between the first and second center electrodes 35 and 36 is set on an as needed basis, and input impedance and insertion loss are adjusted.

Figure 3:
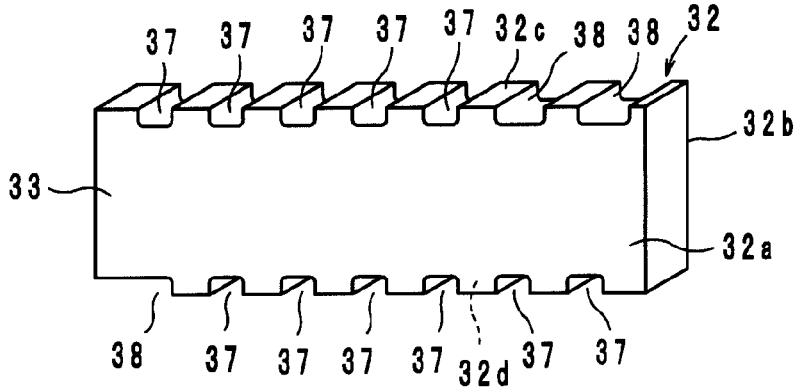
FIG. 3 is a perspective view showing a center layer of the ferrite.

The connection electrodes 35*b*, 35*c*, and 36*p* and the relay electrodes 35*a*, 36*b*, 36*d*, 36*f*, 36*h*, 36*j*, 36*l*, and 36*n* are formed by application of an electrode conductor to recesses 37 (see FIG. 3) formed in the upper surface 32*c* or the lower surface 32*d* or filling the recesses 37 with an electrode conductor. Dummy recesses 38 are also formed in the upper and lower surfaces 32*c* and 32*d* so as to be parallel or substantially parallel with the electrodes, and dummy electrodes 39*a*, 39*b*, and 39*c* are disposed. Each of the electrodes of these kinds is formed by making a through-hole in advance in a mother ferrite substrate being to become the center layer 33, filling the through-hole with an electrode conductor, and then cutting at a position where the through-hole is to be divided. The electrodes may also be formed as a conductive film formed in the recesses 37 and 38.

Each of the permanent magnets 41 can preferably be a strontium, barium, or lanthanum-cobalt based ferrite magnet, for example. As the adhesive 42 for bonding the permanent magnet 41 and the ferrite 32, a one-part thermosetting epoxy resin adhesive is most desirable.

The circuit board 20 preferably is a laminated board in which a plurality of dielectric sheets on which predetermined electrodes are formed are laminated and sintered. As shown in the equivalent circuits in FIGS. 4 and 5, matching capacitors C1, C2, Cs1, Cs2, Cp1, and Cp2 and a termination resistor R are incorporated in the circuit board 20. Terminal electrodes 25*a*, 25*b*, and 25*c* are disposed on the upper surface of the circuit board 20. External-connection terminal electrodes 26, 27, and 28 are disposed on the lower surface of the circuit board 20.

Figure 4:
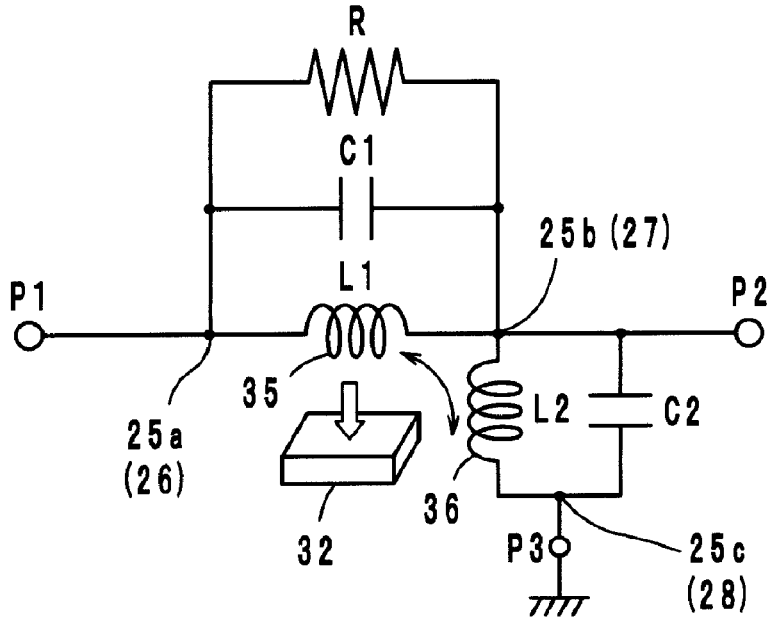
FIG. 4 is an equivalent circuit showing a first circuit example of the two-port isolator.
Figure 5:
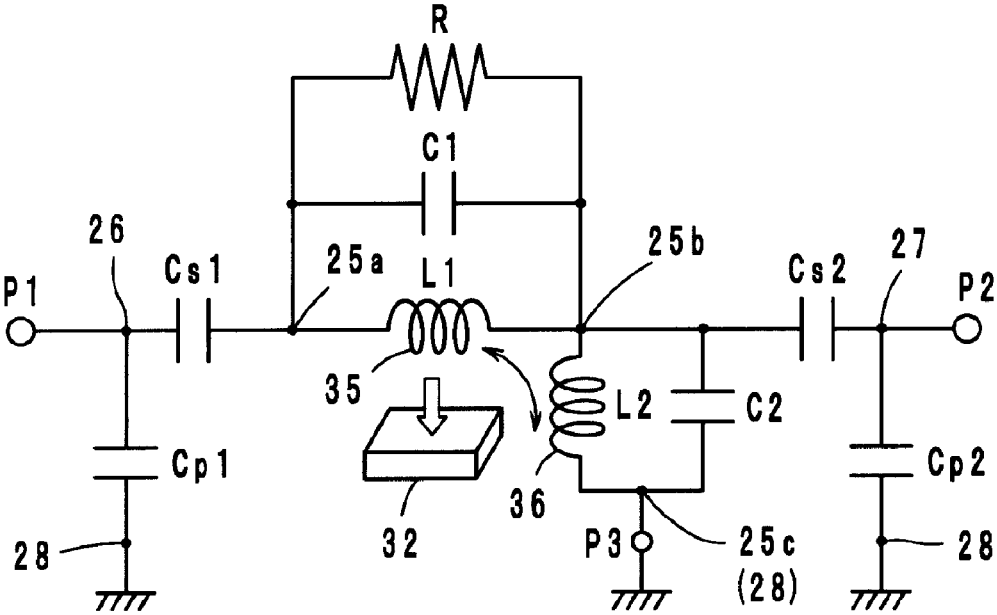
FIG. 5 is an equivalent circuit showing a second circuit example of the two-port isolator.

Examples of the connection relationship between these matching circuit elements and the above-described first and second center electrodes 35 and 36 are shown in FIG. 4, which shows a first example circuit, and FIG. 5, which shows a second example circuit. Here, the connection relationship is described on the basis of the first example circuit shown in FIG. 4.

The external-connection terminal electrode 26, which is disposed on the lower surface of the circuit board 20, functions as an input port P1 and is connected to the matching capacitor C1 and the termination resistor R. The external-connection terminal electrode 26 is connected to a first end of the first center electrode 35 through the terminal electrode 25*a* disposed on the upper surface of the circuit board 20 and the connection electrode 35*b* disposed on the lower surface 32*d* of the ferrite 32.

A second end of the first center electrode 35 and a first end of the second center electrode 36 are connected to the termination resistor R and the capacitors C1 and C2 through the connection electrode 35*c* disposed on the lower surface 32*d* of the ferrite 32 and the terminal electrode 25*b* disposed on the upper surface of the circuit board 20 and are also connected to the external-connection terminal electrode 27 disposed on the lower surface of the circuit board 20. The external-connection terminal electrode 27 functions as an output port P2.

A second end of the second center electrode 36 is connected to the capacitor C2 and the external-connection terminal electrode 28 disposed on the lower surface of the circuit board 20 through the connection electrode 36*p* disposed on the lower surface 32*d* of the ferrite 32 and the terminal electrode 25*c* disposed on the upper surface of the circuit board 20. The external-connection terminal electrode 28 functions as a ground port P3.

In the second example circuit shown in FIG. 5, the capacitors Cs1 and Cp1 are connected to the input port P1, and the capacitors Cs2 and Cp2 are connected to the output port P2. These capacitors are used for impedance adjustment.

The ferrite-magnet assembly 30 is mounted on the circuit board 20. The electrodes disposed on the lower surface 32*d* of the ferrite 32 are integrated with the terminal electrodes 25*a*, 25*b*, and 25*c* on the circuit board 20 by, for example, reflow soldering. The lower surface of the permanent magnet 41 is integrated with the upper surface of the circuit board 20 using an adhesive, for example.

The flat-shaped yoke 10 has the electromagnetic shielding function and is fixed on the upper surface of the ferrite-magnet assembly 30 with a dielectric layer (adhesive layer) 15 disposed therebetween. The flat-shaped yoke 10 has the function of preventing leakage of magnetism and a high-frequency electromagnetic field from the ferrite-magnet assembly 30, preventing effects of magnetism from the outside, and providing a place for allowing the isolator to be picked up using a vacuum nozzle during mounting of the isolator on a substrate (not shown) using a chip mounter. Although grounding the flat-shaped yoke 10 is not necessarily required, the flat-shaped yoke 10 may be grounded using a conductive adhesive or by soldering, for example. Grounding the flat-shaped yoke 10 improves the high-frequency shielding effect.

In the 2-port isolator having the above-described configuration, the first end of the first center electrode 35 is connected to the input port P1, the second end thereof is connected to the output port P2, the first end of the second center electrode 36 is connected to the output port P2, and the second end thereof is connected to the ground port P3. Thus, the 2-port isolator can be a lumped-constant isolator having a small insertion loss. During operation, a large high-frequency current passes through the second center electrode 36, whereas little high-frequency current passes through the first center electrode 35. Accordingly, the direction of a high-frequency magnetic field caused by the first center electrode 35 and the second center electrode 36 is determined by arrangement of the second center electrode 36. The determination of the direction of a high-frequency magnetic field makes it easier to determine how an insertion loss is lowered.

In addition, the ferrite-magnet assembly 30 is mechanically stable because the ferrite 32 and the pair of permanent magnets 41 are integrated with each other preferably using the adhesive 42. Accordingly, the isolator is mechanically stable and resistant to distortion and fracture caused by movement or shock.

In the isolator, the circuit board 20 preferably is a multilayer dielectric board. This allows a circuit network including capacitors and a resistor to be incorporated and also enables a reduction in the size and thickness of the isolator. In addition, because circuit elements are connected to one another within the board, improved reliability can be expected. Of course, the circuit board 20 may have a structure other than a multilayer one. The circuit board 20 may also have a single-layer structure, for example. A chip-type matching capacitor or other elements may also be attached externally.

A material of each of the ferrite 32 and first and second center electrodes 35 and 36 and an example of a manufacturing method thereof are described in the following paragraphs.

First, microwave magnetic substance powder having yttrium oxide ($Y_2O_3$) and iron oxide ($Fe_2O_3$) as the main ingredient and polyvinyl alcohol based organic binder are dispersed into an organic solvent to obtain first slurry. In place of the microwave magnetic substance powder, other magnetic material powder, such as a manganese magnesium ferrite, nickel zinc ferrite, or calcium vanadium garnet, may also be used.

Next, the microwave magnetic substance slurry obtained in the above-described way (first slurry) is formed into a microwave magnetic substance green sheet having a uniform thickness of several tens of micrometers by, for example, a doctor blade method. The green sheet is die-cut into a substantially rectangular shape having, for example, dimensions of 100 mm×100 mm.

As the second slurry, microwave magnetic substance slurry that has a composition being similar to the first slurry and being adjusted so as to have larger saturation magnetization is obtained. The second slurry is formed into a green sheet using a shaping method similar to the above-described method, and the green sheet is die-cut into a substantially rectangular shape having predetermined dimensions. The green sheet may also be shaped by other methods, such as extrusion.

A plurality of green sheets made of the first slurry are laminated to form the center layer 33. The recesses 37 and 38 are formed in the center layer 33 and filled with conductive paste. The first center electrode 35 is preferably formed by screen printing using conductive paste on the principal surfaces 32*a* and 32*b* of the center layer 33. The second center electrode 36 is preferably formed by screen printing using conductive paste on the outer layers 34A and 34B. Cuts for use in continuity with the electrodes disposed on the upper and lower surfaces 32*c* and 32*d* are formed in the outer layers 34A and 34B. The cuts are filled with conductive paste. As the conductive paste for use in forming the electrodes, palladium conductive paste or conductive paste made of a mixture of palladium, silver powder, and an organic solvent can be used, for example. The first and second center electrodes 35 and 36 may also be formed by other methods, such as a gravure transfer method.

The surface of the externally formed second center electrode 36 may preferably be coated with plating made of a metallic material having high conductivity, such as copper or silver, for example.

Then, the center layer 33, on which the first center electrode 35 is formed, and the outer layers 34A and 34B, on which the second center electrode 36 is formed, are laminated and pressurized to obtain a laminated structure. The laminated structure is fired at a temperature between about 1,300° C. and about 1,400° C., and a sinter is obtained. The front and back surfaces of the sinter are bonded to substrates to become the permanent magnets 41, respectively, and a motherboard is obtained. Then, the motherboard is cut into the ferrite-magnet assembly 30 (see FIG. 1) so as to define one unit.

The center layer 33 may also have a composition in which calcium, tin, and vanadium are substituted in yttrium iron garnet (YIG). The center layer 33 has saturation magnetization of about 0.04 T (about 31800 A/m). The outer layers 34A and 34B may also have a composition in which calcium, tin, and vanadium are substituted in YIG. The outer layers 34A and 34B have saturation magnetization of about 0.10 T (about 79600 A/m).

In producing the ferrite-magnet assembly 30, as described above, the center layer 33 and the outer layers 34A and 34B are made of a green sheet using microwave magnetic material. Accordingly, in a firing step, all of three layers have substantially the same sintering temperature and aberration behavior, so a sinter that has no warpage and no crack occurs, and reliability as an isolator is increased. The co-firing simplifies a production process and also eliminates the necessity to use an expensive material, such as glass, in the outer layers (insulting layers) 34A and 34B. This results in a reduction in the cost of production.

Additionally, in the present preferred embodiment, the saturation magnetization of the outer layers 34A and 34B is smaller than that of the center layer 33. When an external magnetic field is applied to the ferrite 32 by the permanent magnet 41 in a perpendicular or substantially perpendicular direction to the principal surfaces 32*a* and 32*b*, because the magnetic substance of the center layer 33 contributes to operations of the isolator, the external magnetic field is provided such that an internal magnetic field matches the center layer 33. The outer layers 34A and 34B have large saturation magnetization, so the internal magnetic field thereof is smaller than that of the center layer 33, as represented in Expression (1). As a result, the outer layers 34A and 34B are magnetically more saturated and have a smaller magnetic permeability μ'+, compared with the center layer 33. Thus, the outer layers 34A and 34B function simply as an insulating layer.

$$Hin=Hex-N\cdot Ms \quad (1)$$

Hin: Internal Magnetic Field
Hex: External Magnetic Field
N: Demagnetizing Factor
Ms: Saturation Magnetization When the external magnetic field Hex is about 91,500 A/m, the demagnetizing factor N is about 0.6, the saturation magnetization Ms of the center layer 33 is about 0.04 T (about 31800 A/m), and the saturation magnetization Ms of the outer layers 34A and 34B is about 0.10 T (about 79600 A/m), the internal magnetic field Hin of the center layer and that of the outer layers are given by the following:

The center layer $Hin=91{,}500-0.6\times 79{,}600=43{,}740$ A/m

The outer layers $Hin=91{,}500-0.6\times 31{,}800=72{,}420$ A/m

Figure 6:
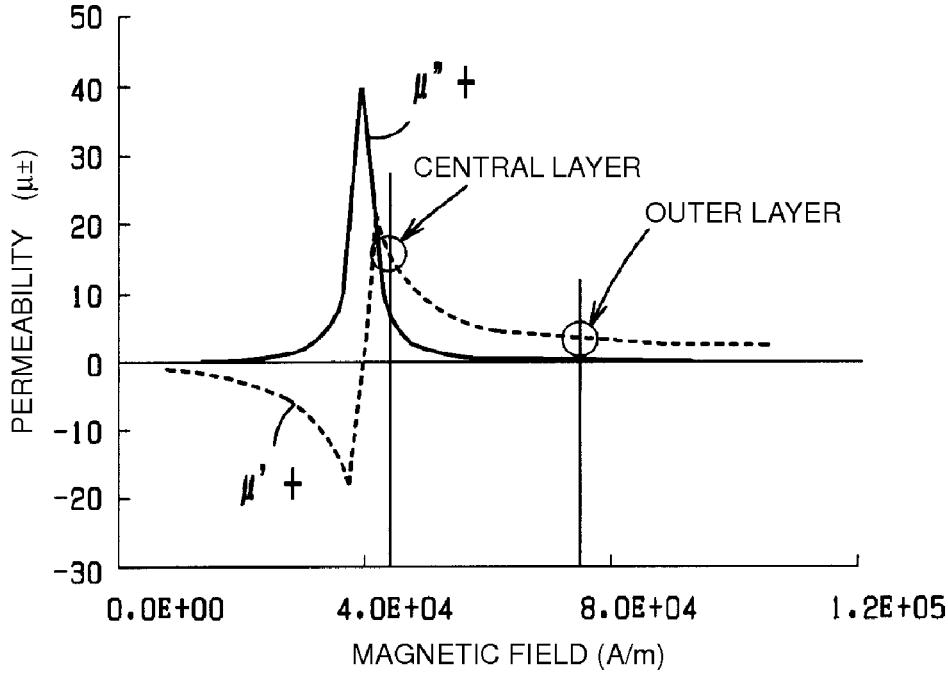
FIG. 6 is a graph showing permeability through a magnetic field in the ferrite.

FIG. 6 shows a magnetic permeability μ± with respect to a magnetic field (A/m). The dotted lines indicate a magnetic μ'+ characteristic, and the solid lines indicates a loss μ"+ characteristic. The magnetic permeability μ'+ of the outer layers is sufficiently smaller than that of the center layer, so the outer layers function as an insulating layer and does not interfere with operations of the isolator.

Figure 7:
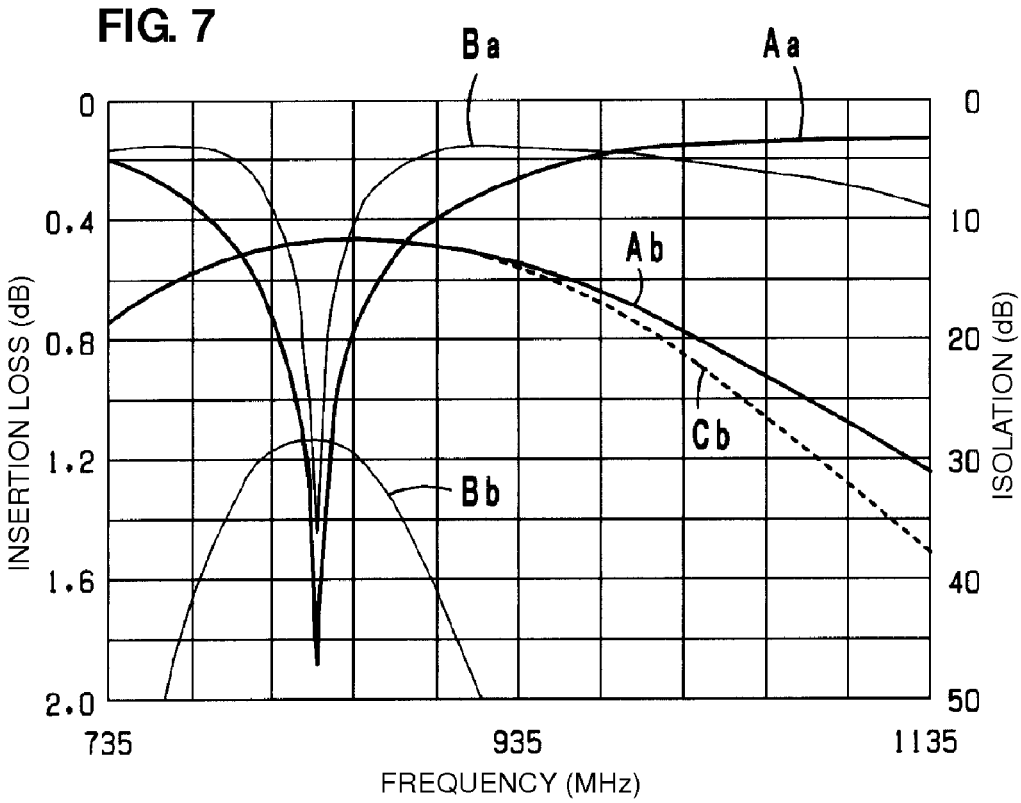
FIG. 7 is a graph showing insertion loss characteristics and isolation characteristics.

FIG. 7 shows insertion loss of the isolator (see the left vertical axis) and isolation (see the right vertical axis) with respect to frequencies. In any of the experimental examples shown, the second center electrode is coated with a copper plating film. The solid lines Aa and Ab represent an isolation characteristic and an insertion loss characteristic, respectively, in Comparative Example 1 in which a magnetic material was used for the central layer and a non-magnetic material was used for the outer layers. The characteristics in Comparative Example 1 are used as reference characteristics. The thin lines Ba and Bb represent an isolation characteristic and an insertion loss characteristic, respectively, in Comparative Example 2 in which magnetic materials (having the same saturation magnetization) were used for the central layer and the outer layers. The characteristics in Comparative Example 2 greatly deteriorate, compared with the characteristics in Comparative Example 1.

In contrast, as shown in the above preferred embodiments, when magnetic material is used in each of the center layer and the outer layers and the saturation magnetization of the outer layers is made smaller than that of the central layer, an isolation characteristic similar to the isolation characteristic Aa in Comparative Example 1 was acquired (a characteristic curve overlaid with the solid line Aa was drawn). An insertion loss characteristic that is substantially similar to the insertion loss characteristic Ab in Comparative Example 1 was acquired, as shown by a dotted line Cb in FIG. 7.

A saturation magnetization of about 0.010 T (about 79,600 A/m) was set for the central layer 33 of the ferrite exhibiting the characteristics in FIG. 7 and a saturation magnetization of about 0.025 T (about 19,900 A/m) was set for the outer layers 34A and 34B thereof in a first example of a preferred embodiment of the present invention, and a saturation magnetization of about 0.010 T (about 79,600 A/m) was set for the central layer 33 of the ferrite exhibiting the characteristics in FIG. 7 and a saturation magnetization of about 0.050 T (about 39,800 A/m) was set for the outer layers 34A and 34B thereof in a second example of a preferred embodiment of the present invention. In either of the examples of a preferred embodiment of the present invention, an isolation characteristic similar to the solid line Aa was acquired and an insertion loss characteristic shown as the dotted line Cb (substantially similar to the solid line Ab) was acquired.

When the saturation magnetization of the center layer 33 is about 0.010 T (about 79,600 A/m) and the saturation magnetization of the outer layers 34A and 34B is about 0.08 T (about 63,660 A/m), (the ratio between the saturation magnetization of the center layer and that of the outer layers is about 1.25:1), the internal magnetic field Hin of the center layer and that of the outer layers are given by the following:

The center layer $Hin=91{,}500-0.6\times 79{,}600=43{,}740$ A/m

The outer layer $Hin=91{,}500-0.6\times 63{,}600=53{,}300$ A/m

As apparent from FIG. 6, the magnetic permeability μ'+ of the center layer 33 and that of the outer layers 34A and 34B are near, and the magnetic field characteristic of the outer layers 34A and 34B interferes with operations of isolation. In view of this and the characteristics shown in FIG. 7, the ratio of the saturation magnetization of the center layer 33 to that of the outer layers 34A and 34B may preferably be two or more. In this case, an increase in insertion loss can be prevented.

In the present preferred embodiment, the second center electrode 36 is preferably arranged outside the first center electrode 35. Accordingly, the cross-sectional area of the coil of the second center electrode 36 is large, the inductance is large, and the insertion loss is small. This is because the insertion loss reduces with a reduction in the ratio of the inductance value L1 of the first center electrode 35 to the inductance value L2 of the second center electrode 36.

Preferably, each of the outer layers 34A and 34B may be thinner than the center layer 33. A reduction in thickness of each of the outer layers 34A and 34B strengthens the coupling between the first and second center electrodes 35 and 36.

In the above nonreciprocal circuit device, the second center electrode may preferably be arranged outside the first center electrode. In this case, the cross-sectional area of the coil of the second center electrode is large, the inductance is large, and the insertion loss is further reduced.

The ratio of the saturation magnetization of the center layer to that of the outer layer may preferably be two or more. In this case, the difference in magnetic permeability between the center layer and the outer layer is large, so this is advantageous in preventing an increase in insertion loss.

The outer layer may preferably be thinner than the center layer. In this case, the coupling of the first and second center electrodes is strengthened.

A nonreciprocal circuit device according to the present invention is not limited to the above preferred embodiments. The above preferred embodiments can be variously changed within the scope of the invention.

For example, if the north pole and the south pole of the permanent magnet 41 are inverted, the input port P1 and the output port P2 are interchanged. In the above preferred embodiments, all of the matching circuit elements preferably are incorporated in the circuit board. However, chip-type inductor and capacitor may be attached to the circuit board externally. Alternatively, a circuit element may also be embedded in the ferrite 32.

The shape of each of the first and second center electrodes 35 and 36 can be variously changed. For example, the first center electrode 35 may also be branched in two on the principal surfaces 32*a* and 32*b*. The second center electrode 36 is wound by at least one turn.

As described above, preferred embodiments of the present invention are useful in a nonreciprocal circuit device and, in particular, advantageous in that the number of steps in a production process can be reduced, the cost can be reduced, and an increase in insertion loss can be prevented.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. A nonreciprocal circuit device comprising:

permanent magnets;

a ferrite to which a direct-current magnetic field is applied by the permanent magnets; and a first center electrode and a second center electrode arranged so as to intersect each other on the ferrite in an insulation state in which the first and second center electrodes are electrically insulated from each other, each of the first and second center electrodes being made of a conductive film;

wherein the ferrite and the permanent magnets define a ferrite-magnet assembly in which the ferrite is sandwiched between the permanent magnets in parallel or substantially in parallel with surfaces of the ferrite on which the first and second center electrodes are disposed;

the ferrite includes a center layer and an outer layer, the outer layer is arranged to ensure an insulation state of the first center electrode and the second center electrode;

saturation magnetization of the outer layer being smaller than saturation magnetization of the center layer.

2. The nonreciprocal circuit device according to claim 1, wherein the first center electrode includes a first end electrically connected to an input port and a second end electrically connected to an output port;

the second center electrode includes a first end electrically connected to the output port and a second end electrically connected to a ground port;

the nonreciprocal circuit device further comprising:

a first matching capacitance electrically connected between the input port and the output port;

a second matching capacitance electrically connected between the output port and the ground port; and a resistor electrically connected between the input port and the output port.

3. The nonreciprocal circuit device according to claim 1, wherein the second center electrode is arranged outside of the first center electrode.

4. The nonreciprocal circuit device according to claim 1, wherein a ratio of the saturation magnetization of the center layer to the saturation magnetization of the outer layer is about two or more.

5. The nonreciprocal circuit device according to claim 1, wherein the outer layer is thinner than the center layer.

6. The nonreciprocal circuit device according to claim 1, wherein the center layer and the outer layer are laminated in the ferrite, and the ferrite and the first and second center electrodes are in an integrally fired state.

7. The nonreciprocal circuit device according to claim 1, further comprising a circuit board including a surface on which a terminal electrode is disposed, wherein the ferrite-magnet assembly is arranged on the circuit board such that the surfaces on which the first and second center electrodes are disposed are arranged in a perpendicular or substantially perpendicular direction to the surface of the circuit board.

* * * * *